United States Patent [19]

Cox

[11] Patent Number: 4,483,114

[45] Date of Patent: Nov. 20, 1984

[54] PREMANUFACTURED CORNER FRAMING AND SUPPORT STRUCTURE

[76] Inventor: Ben N. Cox, 5009 Deer Garden Ct., Raleigh, N.C. 27606

[21] Appl. No.: 373,391

[22] Filed: Apr. 29, 1982

[51] Int. Cl.[3] ..... F04B 1/00

[52] U.S. Cl. ..... 52/281; 52/729; 52/481; 52/275

[58] Field of Search ..... 52/281, 727, 731, 732, 52/730, 729, 481, 275, 285, 586

[56] References Cited

U.S. PATENT DOCUMENTS

| | | | |
|---|---|---|---|
| 780,648 | 1/1905 | Fisher | 52/586 |
| 963,776 | 7/1910 | Kosack | 52/426 |
| 1,846,625 | 11/1930 | Whiting | 52/275 |
| 2,089,866 | 8/1937 | Wallentin | 52/281 |
| 2,118,048 | 3/1937 | Landsem | 52/731 |
| 3,079,649 | 3/1963 | Willatts | 52/731 |

FOREIGN PATENT DOCUMENTS

| | | | |
|---|---|---|---|
| 807549 | 4/1951 | Fed. Rep. of Germany | 52/729 |
| 253184 | 5/1967 | Fed. Rep. of Germany | 52/729 |
| 511449 | 6/1955 | Italy | 52/275 |

*Primary Examiner*—John E. Murtagh
*Assistant Examiner*—Kathryn L. Ford
*Attorney, Agent, or Firm*—Mills & Coats

[57] ABSTRACT

The present invention relates to a premanufactured corner framing structure adapted to be interposed between two angled framed wall sections to form a corner. In connecting the two framed wall sections, the corner frame structure is inserted vertically between the lower plate and upper plate structures of the respective wall sections. In the particular design disclosed herein, the premanufactured corner framing and support structure includes a plywood web with a pair of vertically extending flanges formed adjacent an inner edge of the web and a pair of vertically extending flanges formed adjacent an opposed outer edge of the web such that said flanges are generally aligned on each side of said plywood web and maintained in spaced apart relationship by the web itself. Consequently, it is appreciated that the corner load of the structure is carried by the flanges and the composite structure of the flanges and plywood web.

1 Claim, 4 Drawing Figures

PREMANUFACTURED CORNER FRAMING AND SUPPORT STRUCTURE

FIELD OF INVENTION

The present invention relates to static structures and to wall framing, and more particularly to a premanufactured corner frame support structure designed to be interposed between two wall sections disposed and angled relative to each other to form the corner framing portion of the completed wall structure.

BACKGROUND OF INVENTION

In framing residential dwellings, it is common practice to construct corner framing assemblies at the site of the construction. Typically most exterior wall corner assemblies are constructed using three two-inch nominal wooden members. These members are generally assembled and disposed such that the respective wooden members extend at ninety degree angles relative to each other.

There are numerous disadvantages and drawbacks to this type of corner frame construction. First, the basic approach as referred to above requires more material than is necessary to carry the imposed loads. Next the fabrication of the corner assembly at the construction site is quite inefficient and time consuming. Consequently, due to the extra material used and the labor required at the construction site, one can expect the total cost of such corner frame assemblies to be relatively high.

With conventional on-site fabrication of corner frame assemblies because of the very nature of the design, it is difficult, if not impossible, to insulate the corner of the framed walls. This is especially significant because the design itself tends to create areas that allow air infiltration through the wall structure. Consequently there is apt to be significant energy loss through the corners of exterior walls due to the corner framing construction utilized.

SUMMARY AND OBJECTS OF INVENTION

The present invention presents a prefabricated or premanufactured corner frame structure that is designed to overcome the disadvantages and drawbacks of conventional on-site constructed corner framing assemblies. Generally in the design disclosed herein, the corner framing structure of the present invention entails an elongated plywood web having a pair of wooden elongated flanges secured about opposed sides of the web adjacent an inner facing edge thereof, while a second pair of elongated wooden flanges are disposed about opposite sides of the web adjacent an outer facing edge thereof. Two framed wall sections are brought together to form a selected corner angle and the corner framing structure is interposed between the two framed wall sections so as to extend between the lower plate and upper plate structures thereof. The corner framing structure is oriented such that the plane of the plywood web generally divides the angle formed by the wall sections into halves such that the plywood web does not extend normal to either wall section but generally is disposed at an angle with respect to both.

It is, therefore, an object of the present invention to provide an unitized corner frame structure that can be readily interposed and secured between two wall sections set at an angle relative to each other to form the structural framing for the defined corner.

It is also an object of the present invention to provide a corner frame structure design that is suitable for prefabrication or manufacturing.

Another object of the present invention resides in the provision of a premanufactured corner frame structure that is relatively simple and inexpensive.

Another object of the present invention resides in the provision of a corner frame structure of the type referred to above that allows the framing wall structure in and around the corner area to be easily and conveniently insulated.

Another object of the present invention resides in the provision of a corner frame structure design that efficiently utilizes material for load carrying strength and wherein the material required to form such a structure is less costly than material conventionally used in conventional on-site corner framing fabrication.

Still a further object of the present invention resides in the provision of a high quality premanufactured corner frame structure that is adapted to be interposed between two framed wall sections to form the framing portion of the corner of a wall wherein the labor required to fabricate or manufacture the corner frame structure is significantly reduced.

Another object of the present invention resides in the provision of a premanufactured corner frame structure of the character referred to above that is easily and conveniently manufactured and adapted for use with various width walls and which is also easily adapted for use in corner constructions where the angle of the defined corner varies.

Another object of the present invention resides in the provision of a premanufactured corner frame structure insert device that can be constructed of various materials including standard commercially available wood members.

It is also an object of the present invention to provide a premanufactured corner frame structure insert device that is fabricated and constructed from plywood and elongated stud members such as wooden members having a nominal thickness of two inches.

Other objects and advantages of the present invention will become apparent from a study of the following description and the accompanying drawings which are merely illustrative of the present invention.

DESCRIPTION OF A PREFERRED EMBODIMENT

Figure 1:
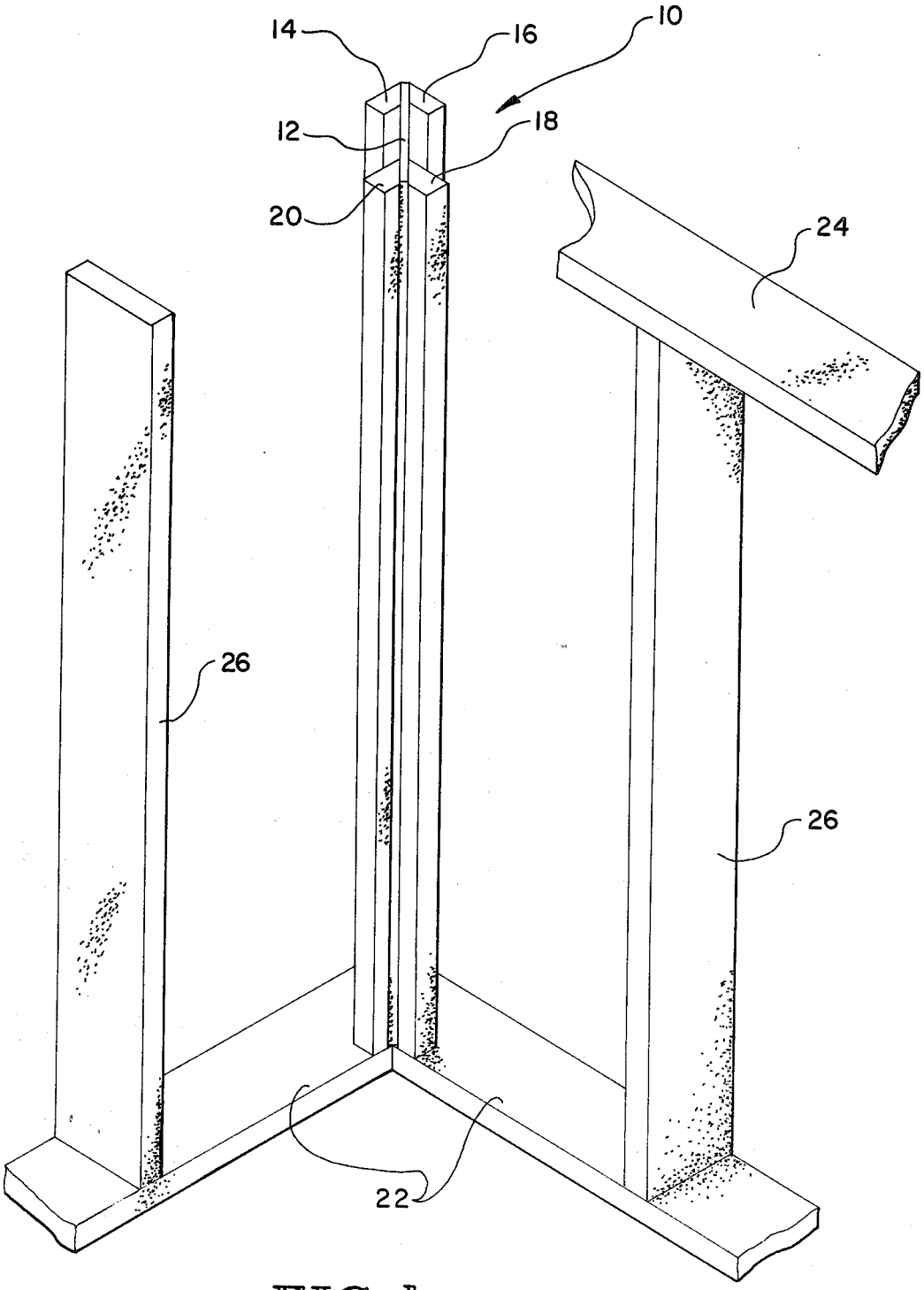
FIG. 1 is a fragmentary perspective view of two wall sections disposed at an angle and including the corner framing structure of the present invention.

With further reference to the drawings, particularly FIG. 1, there is shown two framed wall sections joined together so as to define a corner and a selected angle between the respective wall sections. In this regard, it is seen that each wall section includes a lower plate 22 and a plurality of studs 26 extending from plate 22 upwardly to where the same joins an upper plate member 24.

Figure 3:
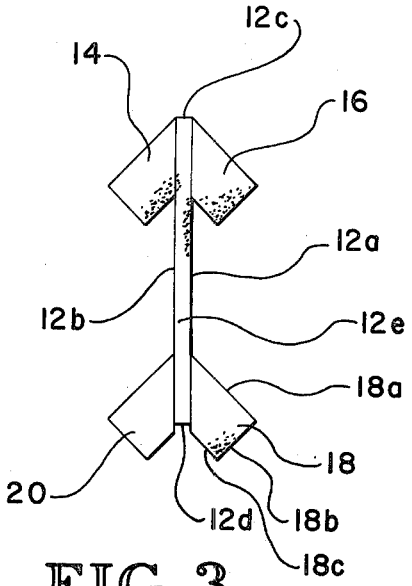
FIG. 3 is a top plan view of the corner frame structure of the present invention.
Figure 4:
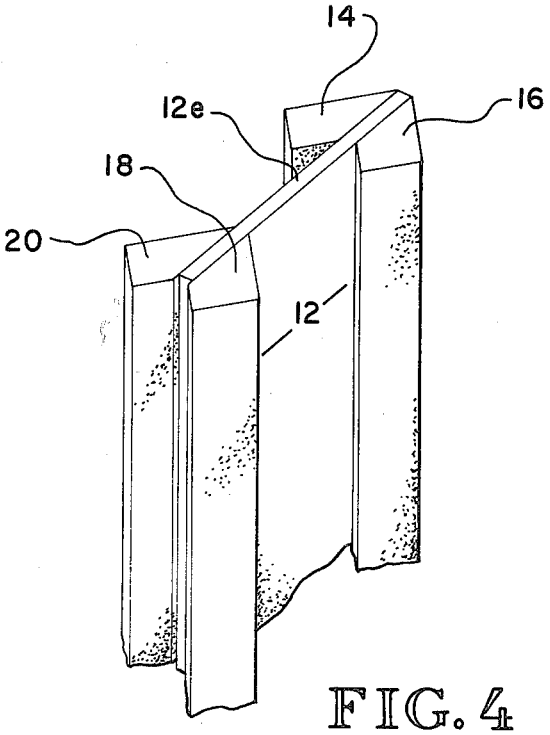
FIG. 4 is a fragmentary perspective view of a portion of the corner frame structure of the present invention.

The corner frame structure of the present invention is illustrated in the drawings and indicated generally by the numeral 10. As seen in FIGS. 1, 3 and 4, the corner frame structure 10 includes an elongated plywood web 12 that is relatively thin in thickness and includes two opposing sides 12*a* and 12*b*, inner and outer edges 12*d* and 12*c*, respectively, and an upper edge 12*e*.

Secured to the plywood web 12 is flange means in the form of a series of flange members 14, 16, 18 and 20. It is appreciated that the respective flange members can be secured to the plywood web 12 by nails, adhesive, a combination of nails and adhesive, or any other suitable means.

In the case of the design embodiment illustrated herein, it is seen that flange members 18 and 20 are termed inner flange means or inner flange members because they are secured and disposed adjacent inner edge 12*d* of plywood web 12. Likewise, flange members 14 and 16 are termed outer flange means or outer flange members because they are disposed and secured adjacent outer edge 12*c* of plywood web 12.

Figure 2:
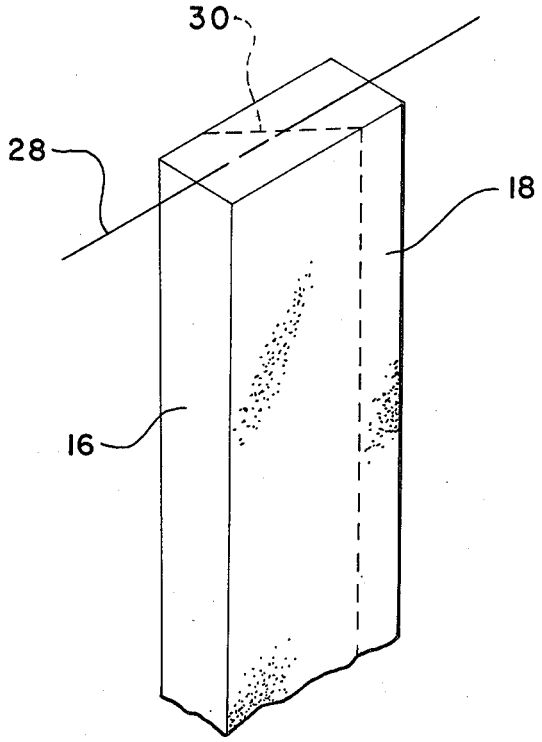
FIG. 2 is a fragmentary perspective view of a nominal two-inch stud illustrating how the same may be selectively cut to form a pair of flange members that form a part of the corner framing structure of the present invention.

In the embodiment illustrated herein, the respective flange members can be cut from a nominal two-inch by four-inch wooden stud, as illustrated in FIG. 2. In this regard the two by four wooden stud is cut along the dotted lines 30 and is cut at an angle of forty-five degrees with respect to construction line 28 that extends normal to the longitudinal axis of the stud. Thus, by cutting the stud illustrated in FIG. 2 by this means, it is seen that two like flange members 16 and 18 are derived therefrom. In particular, it is appreciated that the respective flange members 16 and 18 are of like shape and size in cross section.

After forming or cutting the elongated stud as discussed hereinabove and as particularly illustrated in FIG. 2, it is seen that flange member 18 is oriented such that the cut side fits flush adjacent a side portion of plywood web 12. The other three remaining sides 18*a*, 18*b* and 18*c* are oriented as shown in FIG. 3. It is appreciated that the opposing elongated flange 20 would be likewise oriented and have sides of corresponding dimensions.

In use the corner frame structure 10 is interposed between two wall sections, as illustrated in FIG. 1. It is appreciated that the corner frame structure 10 is inserted between the lower plate structure 22 and upper plate structure 24 of the two wall sections. Also as illustrated in FIG. 1, it is seen that the corner frame structure is oriented such that the plane of plywood web 12 extends at an angle to both wall sections. Expressed in another way, the plane of plywood web 12 extends such that it forms an angle with one wall section on one side and a second angle with the wall section on the other side and wherein the two angles formed are generally equal.

Once secured between said framed wall sections, the corner frame structure 10 is properly positioned to carry the load imposed upon the corner areas of the respective wall structure. In this regard, it is appreciated that the elongated flanges 14, 16, 18 and 20 are designed so as to assume the principal load carrying function. The web 12, however, functions to interconnect the respective flanges and to maintain them in proper spaced apart relationship and further contributes to the overall strength of the corner frame structure 10.

It is appreciated that the innermost sides or edges of inner flanges 18 and 20 serve to receive the inner wall structure of the house, such as Sheetrock, paneling, etc. Likewise, the outer sides or edges of outer flanges 16 and 14 are particularly adapted to receive the outer side wall structure of the building such as exterior paneling, siding, etc.

It is appreciated that the corner frame structure 10 of the present invention can be particularly designed and dimensioned for walls of various thickness. In the case of a nominal six-inch thick wall, the same can be produced by using a one-half inch plywood section eight inches wide and two nominal two by four studs. Compared to conventional construction, this reduces the material cost for the corner structure by approximately $1.30.

As a preliminary to testing the present invention, the load on a corner of the lower story of a two-story house forty feet wide was calculated to be approximately 2900 pounds (design load). Therefore, a load of 3000 pounds was chosen as a comparison and samples were tested in compression without lateral support for the full length of ninety-three inches.

In one group of samples, the design was such that the respective flanges were only nailed to the plywood web. In this group of samples, a deflection at mid-span of 3/32nd inch, 1/16th inch, and 1/32nd of an inch was found when loaded to 3000 pounds. The maximum load carrying capability ranged from 8000 pounds to 10,500 pounds before the samples lost their load carrying capability.

In a second group of samples, the respective flanges were both nailed and glued to the plywood web 12. In this case a mid-span deflection at 3000 pound load of 1/8th inch, ⅛th inch and 1/32nd inch, respectively, was recorded. The load carrying capability ranged from 11,000 pounds to 16,500 pounds before these sample corner framed structures lost their load carrying capability.

It is believed that a deflection of 1/8th inch at mid-height would not be objectionable in normal residential construction. It is appreciated that even the recorded deflections may not occur when the respective wall sections are reinforced by wall coverings.

From the foregoing specification and description, it is contemplated that the corner frame structure of the present invention can easily and conveniently be prefabricated or premanufactured from various suitable materials. The design illustrated herein is one contemplated embodiment of the present invention. It is thusly appreciated that the corner frame structure insert or assembly of the present invention has the capability of reducing both material and the labor cost over conventional construction techniques for the corner framing structure used within framed walls of residential structures. In addition the design of the present invention enables the corner to be easily insulated and in fact improves the resistance of the wall structure by reducing heat losses and gains to the interior of the structure. Also, the corner frame structure of the present invention provides an attachment surface for the full height of inside and outside wall coverings about the framed corner.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In a wood framed wall structure including a pair of wood wall frame sections, with each having an inner and outer side, extending from a corner structure, the inprovement comprising a premanufactured wood corner frame support structure designed to be interposed and connected between said two wall framing sections to form a framed wall structure wherein the premanufactured wood corner frame support structure is designed for carrying and supporting axial loads bearing on the framed wall structure thereover, said axial load carrying premanufactured wood corner frame structure as vertically oriented and interposed between said two wood wall framing sections comprising: a vertical plywood web that extends vertically between said two wall framing sections and which includes opposed sides and inner and outer edges and wherein said plywood web includes a transverse width that is defined by that distance between said inner and outer edges and wherein said transverse width is approximately equal to the width of a respective wall framing section, and wherein said plywood web itself includes a thickness that is defined by the distance between opposed sides and wherein said web thickness is relatively thin as compared to said transverse width; an inner corner structure secured vertically to opposed sides of said plywood web adjacent said inner edge thereof, said inner corner structure including a pair of inner elongated vertical wood flanges secured to opposed sides of said web adjacent said inner edge of said web and wherein said inner elongated wood flanges extend substantially the vertical height of said web and extend in parallel relationship to each other and said inner edge; each inner wood flange including an elongated half two inch by four inch wood section cut from a nominal two inch by four inch wood member by diagonally cutting in half said two inch by four inch wood member from one end to the other end and wherein said diagonally cut half two inch by four inch section includes a diagonal cut face that normally abutts directly to and is connected to said plywood web to form a respective inner flange; said inner corner structure including a pair of inner side wall receiving surfaces formed by said diagonally cut two inch by four inch sections and wherein said inner side wall receiving surfaces aligned with and are generally coplanar with the inner side of the respective wood wall frame section so as to form a generally continuous coplanar inner side wall structure for receiving a selected inner wall covering along said wall frame structure formed by said wall frame sections and said premanufactured corner frame structure; an outer corner structure formed vertically along opposed sides of said plywood web adjacent the outer edge thereof and including a pair of outer elongated vertical wood flanges secured to opposed sids of said plywood web adjacent said outer edge thereof and wherein said outer elongated wood flanges extend substantially the vertical height of said web and extend in parallel relationship to each other and said outer edge of said plywood web; each outer wood flange including an elongated half two inch by four inch wood section formed from a nominal two inch by four inch wood member by diagonally cutting in half said two inch by four inch wood member from one end to the other end and wherein said diagonally cut half two inch by four inch section includes a diagonally cut face that normally abutts directly to and is connected to said plywood web to form a respective outer wood flange; and wherein said outer corner structure includes a pair of outer side wall receiving surfaces formed by said outer elongated diagonally cut half two inch by four inch flanges and wherein said outer side wall receiving surfaces align with and are generally coplanar with the outer sides of the respective wall frame sections so as to form a generally continuous coplanar outer side wall structure for receiving a selected outer wall covering along said wall frame structure formed by said frame sections and said premanufactured corner frame structure interposed between said wall frame sections whereby said premanufactured corner frame structure carries and supports a vertical corner load and further by the provision of said inner and outer side wall receiving surfaces allow selective inner and outer side wall coverings to be applied continuously and smoothly from the respective wall frame sections to the corner frame structure and further permits the selected side wall covering to be actually secured directly to the respective inner and outer wall receiving surfaces of said premanufactured corner frame structure.

* * * * *